US010765579B2

(12) United States Patent
Giambattista et al.

(10) Patent No.: US 10,765,579 B2
(45) Date of Patent: Sep. 8, 2020

(54) INCUBATOR FOR THE TRANSPORT OF HIGH-RISK INFANTS

(71) Applicant: GINEVRI S.R.L., Albano Laziale (IT)

(72) Inventors: Angela Giambattista, Albano Laziale (IT); Loredana Di Lucchio, Albano Laziale (IT)

(73) Assignee: GINEVRI S.R.L., Albano Laziale (IT)

( * ) Notice: Subject to any disclaimer, the term of this patent is extended or adjusted under 35 U.S.C. 154(b) by 393 days.

(21) Appl. No.: 15/736,048

(22) PCT Filed: Jun. 15, 2016

(86) PCT No.: PCT/IT2016/000157
§ 371 (c)(1),
(2) Date: Dec. 13, 2017

(87) PCT Pub. No.: WO2016/203503
PCT Pub. Date: Dec. 22, 2016

(65) Prior Publication Data

US 2018/0177656 A1 Jun. 28, 2018

(30) Foreign Application Priority Data

Jun. 18, 2015 (IT) ..... 202015000025181 U

(51) Int. Cl.

| | |
|---|---|
| ***A61G 11/00*** | (2006.01) |
| ***F26B 17/04*** | (2006.01) |
| ***F26B 17/10*** | (2006.01) |
| *A61G 1/00* | (2006.01) |

(52) U.S. Cl.
CPC ..... *A61G 11/007* (2013.01); *A61G 11/006* (2013.01); *A61G 11/009* (2013.01); *F26B 17/045* (2013.01); *F26B 17/101* (2013.01); *F26B 17/103* (2013.01); *A61G 1/00* (2013.01); *A61G 2203/20* (2013.01); *A61G 2203/80* (2013.01); *A61G 2210/50* (2013.01)

(58) Field of Classification Search
CPC .. A61G 11/006; A61G 11/007; A61G 11/009; A61G 1/00; A61G 2203/20
See application file for complete search history.

(56) References Cited

U.S. PATENT DOCUMENTS

| | | | | |
|---|---|---|---|---|
| 4,321,913 A * | 3/1982 | Maluta | ..... | A61G 11/00 312/209 |
| 2006/0136020 A1 | 6/2006 | Dussault | | |
| 2007/0000043 A1 | 1/2007 | Nakayama | | |
| 2010/0084526 A1 | 4/2010 | Moffitt et al. | | |

FOREIGN PATENT DOCUMENTS

| | | |
|---|---|---|
| GB | 2 389 535 A | 12/2003 |
| WO | WO 2009/073784 A1 | 6/2009 |

* cited by examiner

*Primary Examiner* — Christine H Matthews
(74) *Attorney, Agent, or Firm* — Muncy, Geissler, Olds & Lowe, P.C.

(57) ABSTRACT

A transport incubator includes a support structure having a base provided with at least one first guide, and a housing structure coupled with the supporting structure. The housing structure includes a first portion having at least one first side panel slidably coupled with the first guide of the base, and a second portion laterally delimited by at least one first side wall, on which the at least one first side panel of the first portion slides.

10 Claims, 4 Drawing Sheets

INCUBATOR FOR THE TRANSPORT OF HIGH-RISK INFANTS

BACKGROUND OF THE INVENTION

Field of the Invention

The present invention relates an incubator for the transport of high-risk infants.

More specifically, the invention concerns a transport incubator capable to accommodate and maintain high-risk infants in a controlled environment during transportation by ambulance, airplane, helicopter and the like, from the place of birth to the Neonatal Intensive Care Department.

Brief Discussion of the Related Art

It has long been known that the transport of pathological or immature newborn, from the place of birth to the Intensive Care Center of a hospital, involves substantial risk and can often cause even irreversible worsening of the already precarious conditions of the newborn.

Therefore, the use of an apparatus that regulates the temperature and humidity levels and allows the immature or premature newborn to enjoy conditions similar to those of the intrauterine environment is necessary.

Currently, known transport incubators allow to adjust both the temperature, humidity and other environmental parameters and to associate other life support equipment for pulmonary ventilation, oxygenation and related equipment tester for functional verifications, for the newborn transportation.

However, in known transport incubators, visual monitoring and the access to medical interventions on premature, that are limited by the structure of the system, are often difficult.

In addition, the transportation of premature and/or infants from birth place to images diagnostic rooms, or from a Neonatal Intensive Care Unit to the images diagnostic rooms, requires the newborn to be moved from the incubator on the specific thermographic equipment deck chairs such as the apparatus of Magnetic Resonance Imaging—MRI, or the apparatus of Computerized Axial Tomography—CT and the like, and this causes considerable temperature changes and the interruption of the assisted monitoring.

SUMMARY OF THE INVENTION

In light of the above, it is therefore object of the present invention providing a light transport incubator, easy to handle and compatible with the transport means such as ambulance, airplane, helicopter ambulance and the like, to allow a quick intervention.

A further object of the invention is to prevent the risks arising from the transport of a premature newborn from the birth place to the Neonatal Intensive Care Departments, allowing the quick start of intensive care and reanimation and allowing the transport of the newborn in full safety during the diagnosis and/or therapy phases.

Another object of the invention is to allow a better accessibility, both visual and manual, to the patient during the permanence within the incubator.

It is therefore specific object of the invention a transport incubator comprising a support structure comprising a base, provided with at least one first guide, a housing structure, coupled with said supporting structure, comprising a first portion having at least one first side panel slidably coupled with said first guide of said base, and a second portion, laterally delimited by at least one first side wall, on which at least said first panel of said first portion slides.

Further according to the invention, said base is provided with a second guide, arranged parallel with respect to said first guide, said first portion comprises a second side panel, arranged facing to said first side panel, slidably coupled to said second guide of said base, and said second portion is delimited by a second side wall, arranged facing with respect to said first side wall, on which said first portion of said second panel slides.

Still said supporting structure comprises a frame comprising a first curb and a second curb, on which a plurality of U-shape support elements, for the passage of fastening straps, are hooked.

Preferably according to the invention, said supporting structure comprises a U-shaped supporting base, which can be coupled with said frame and on which said base is fixed.

Further according to the invention, said base has, on its lateral surface, a through slot, said support base has laterally a through slot overlapped on said through slot of said base, and it comprises a tray removable from the inside outward said first portion for the insertion and the subsequent extraction of radiographic sheets.

Still according to the invention, said base is provided with a first support frame, arranged parallel and beside to said first guide, and a second support frame arranged beside and parallel to said second guide, and said first portion comprises a perforated base, sliding on said first and second support frame, on which perforated base a newborn can be rested.

Preferably according to the invention, said first side panel of said first portion comprises a first porthole, provided with an opening handle and a second porthole, provided with an opening handle, and said second side panel of said first portion comprises a first porthole provided with an opening handle and a second porthole provided with an opening handle.

Further according to the invention, said first portion is delimited at the top by a dome coupled with said first and second panel.

Still according to the invention, said dome and said first and second panel are made of transparent plastic material.

Preferably according to the invention, said second portion is delimited at the top by a top cover, coupled with said first and second side wall, in which a monitor for displaying said vital parameters of said newborn accommodated within said first portion is integrated.

Further according to the invention, said monitor is coupled with said top cover by a hinge, and said monitor passes from a rest position, in which it is inserted into a housing of said top cover, to a parameter display position, by rotating around said hinge.

BRIEF DESCRIPTION OF THE DRAWINGS

The present invention will be now described, for illustrative but not limitative purposes, according to its preferred embodiments, with particular reference to the figures of the enclosed drawings, wherein.

DETAILED DESCRIPTION OF THE PREFERRED EMBODIMENTS

Figure 1:
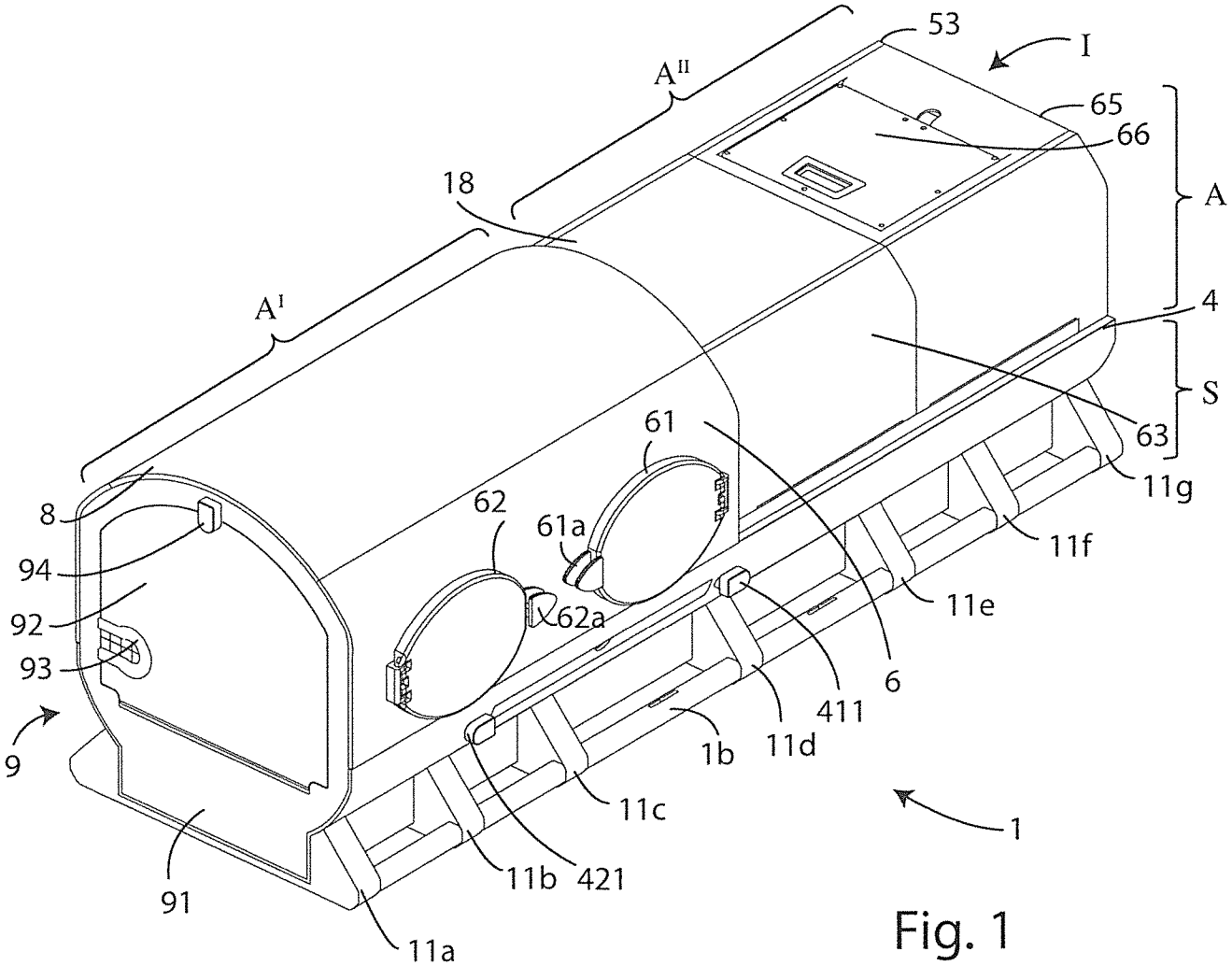
FIG. 1 shows an isometric view in closed configuration of the incubator object of the present invention.
Figure 2:
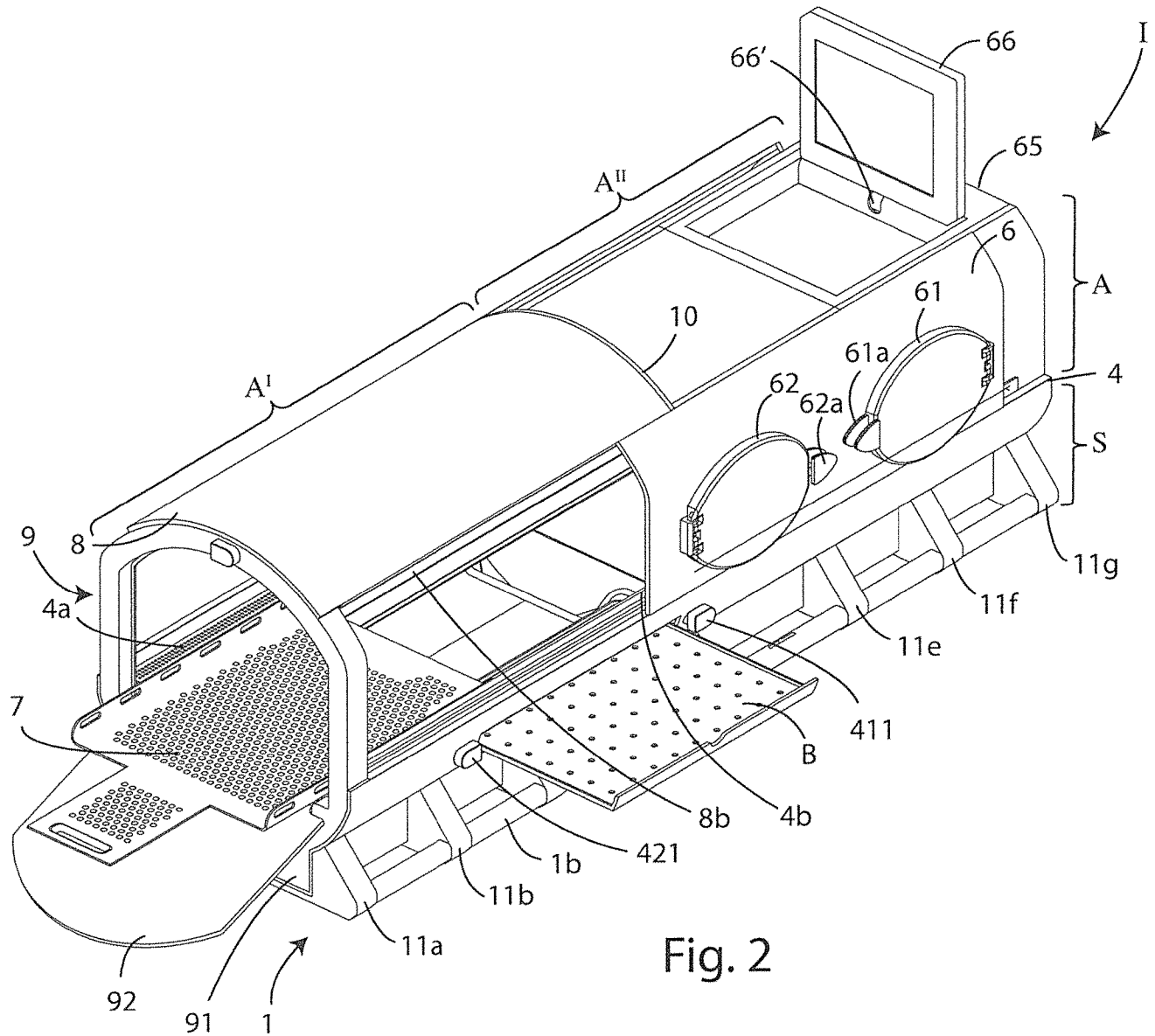
FIG. 2 shows an axonometric view in open configuration of the incubator of FIG. 1.
Figure 3:
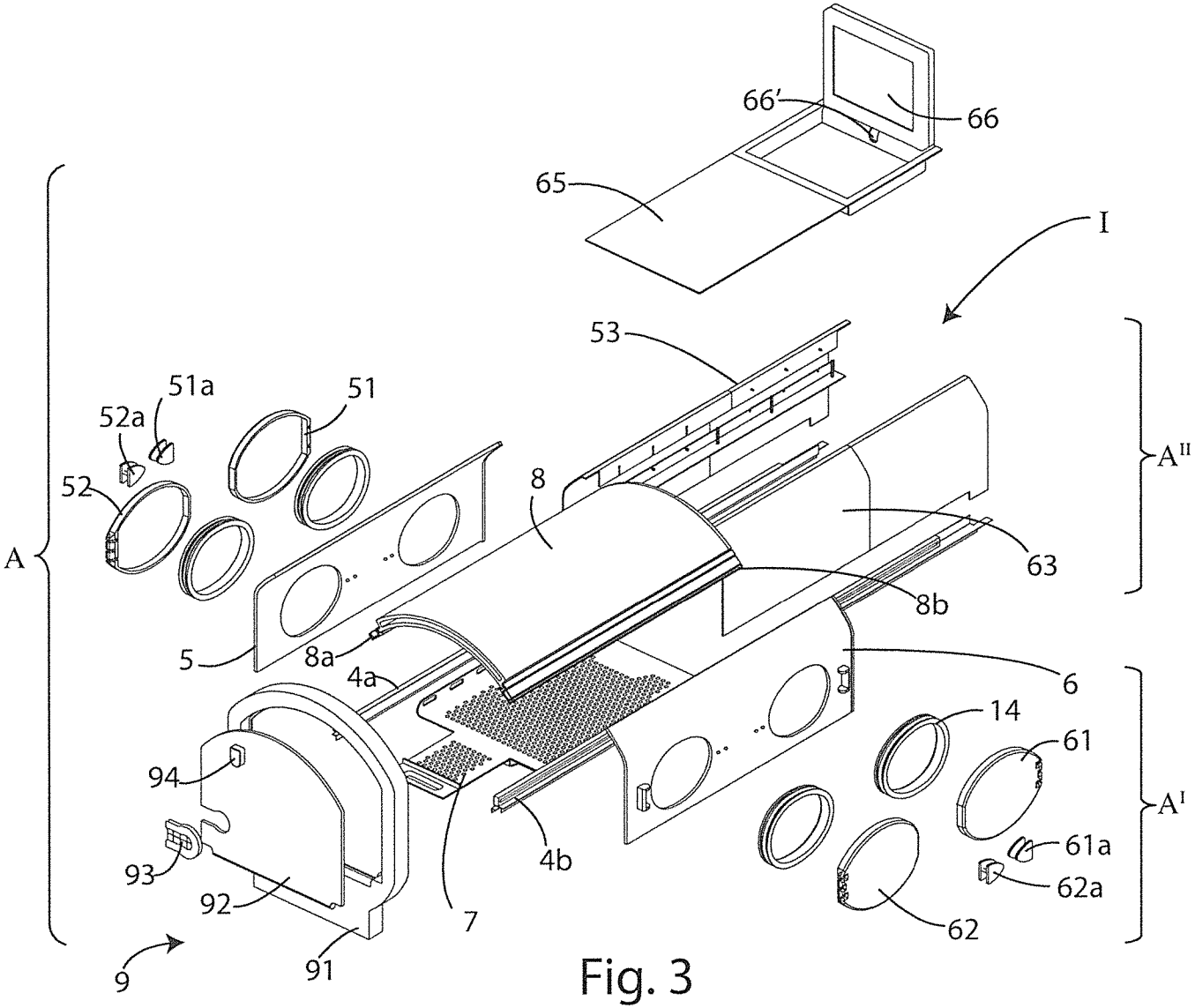
FIG. 3 shows an exploded view of the components of the upper part of the incubator of FIG. 1.
Figure 4:
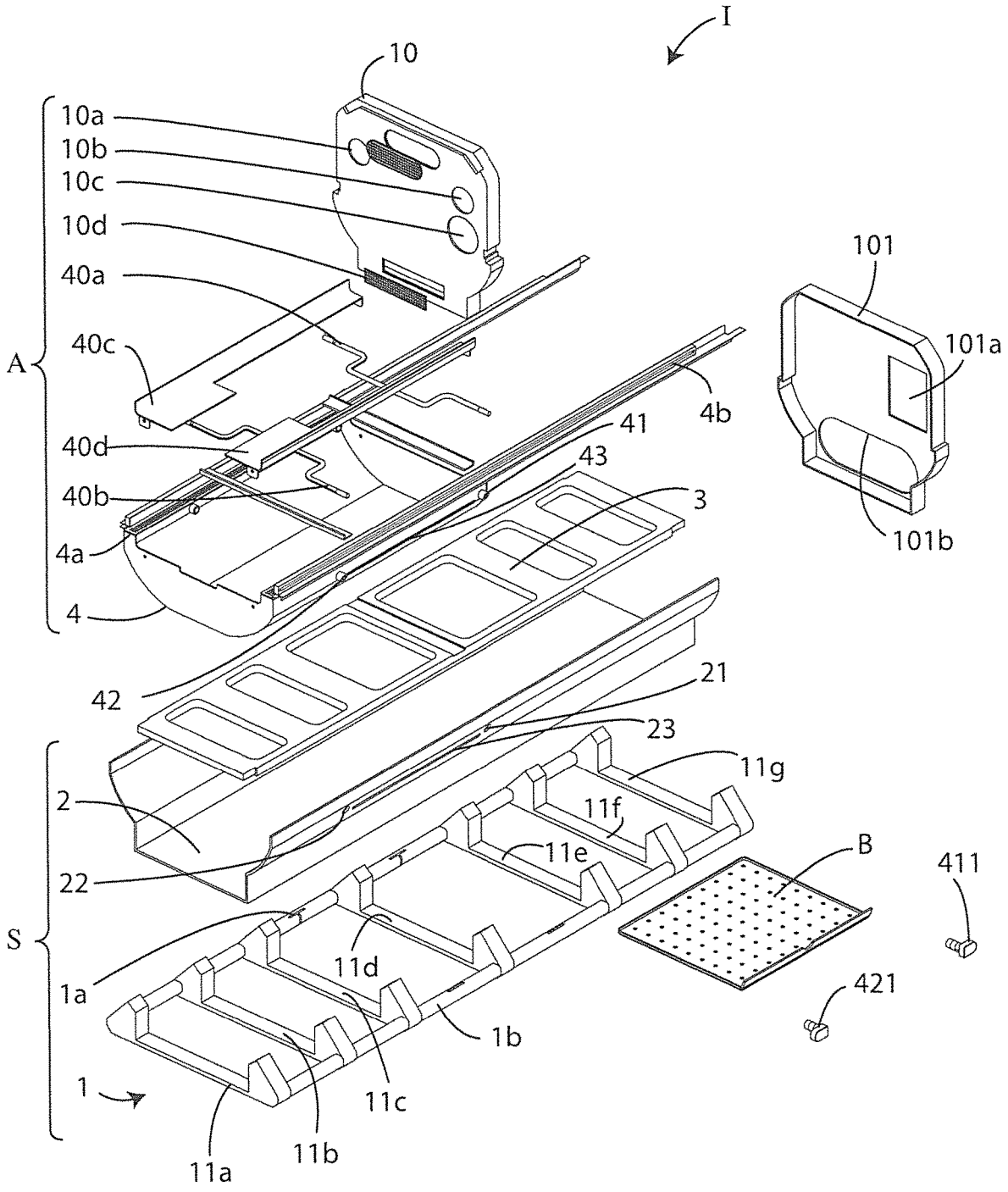
FIG. 4 shows an exploded view of the components of the lower part of the incubator of FIG. 1.

In the various figures, similar parts will be indicated by the same reference numbers.

Referring to the enclosed figures, the incubator object of the invention, referred to with the reference I, comprises a supporting structure S made of plastic material, shaped so as to be fixed, by means of passing-belts, to any type of media being used for the transport emergency such as folding trolleys, beds for intra-hospital transport, spinal stretchers and the like, and a housing structure of the high-risk infant.

Said supporting structure S comprises a frame 1 comprising a first curb 1*a* and a second curb 1*b*, on which a plurality of U-shaped supporting elements 11*a*, 11*b*, . . . , 11*g* are hooked.

Said first 1*a* and second 1*b* curb allow the passage of passing-belts, not shown in the figures, to firmly engage said incubator I with said transport beds, spinal stretchers and the like.

Said supporting structure S comprises a U-shaped support base 2, which is coupled with said frame 1, in particular with said plurality of support elements 11*a*, 11*b*, . . . , 11*g*.

Said support base 2 has, on its lateral surface, a first hole 21 and a second hole 22 for housing knobs, which will be described in detail below, and a through slot 23, which will be described in detail below.

Said support structure S also includes a grid 3, which is coupled with said support base 2, on which said housing structure A is supported.

Said housing structure A comprises a base 4, which is coupled with said bearing structure S.

A first guide 4*a* and a second guide 4*b* are fixed on said base 4 of said housing structure A, for the sliding of panels that will be described in detail below.

In particular, said base 4 has, on its lateral surface, a first pin 41, a second pin 42, and a through slot 43.

Said first pin 41 is inserted in said first hole 21 of said support base 2 and is locked by a first knob 411, said second pin 42 is inserted in said second hole 22 of said support base 2 and is locked by a second knob 421, and said through slot 23 of said support base 2 overlaps said through slot 43 of said base 4, during the coupling between said housing structure A and said support structure S.

Said first 411 and second 421 knob are used to actuate the lift system of the bed, on which the infant lies.

In particular, said lift system comprises a first tube 40*a*, connected with said first pin 41, a second pipe 40*b*, connected with said second pin 42, a first support frame 40*c*, placed on said base 4 and put beside said first guide 4*a* and a second support frame 40*d*, placed on said base 4 and put beside said second guide 4*b*.

On said first 40*c* and second 40*d* support frame the bed that will be described later is placed.

Said housing structure A comprises a first portion A' and a second portion A".

Said first portion A' comprises a first side panel 5 and a second side panel 6, both made of transparent material and slidably coupled respectively with said first 4*a* and second 4*b* guide of said base 4. Said first side panel 5 is provided with a first porthole 51 and a second porthole 52, which allow the access from the outside of the medical staff's hands to the inside of said first portion A'. Said first porthole 51 is provided with an opening handle 51*a* and said second porthole 52 is provided with an opening handle 52*a*.

Said first portion A' further comprises a second side panel 6, made of transparent material, arranged faced to said first side panel 5, slidingly coupled with said second guide 4*b* of said base 4.

Said second side 7 panel 6 is provided with a first porthole 61 and a second porthole 62, which allow the access from the outside of the medical staff's hands to the inside of said first portion A'. Said first porthole 61 is provided with an opening handle 61*a* and said second porthole 62 is provided with an opening handle 62*a*.

Said first portion A' includes a perforated base or bed 7, slidingly coupled to said first support frame 40*c* and to said second support frame 40*d*, on which the newborn is placed, and a tray B which slides from the inside to the outside of said first portion A' through said slot 43 of said base 4 and the slot 23 of said support base 23.

Said tray B is adapted to contain radiographic sheets, in order to carry out X-ray examinations to infants, while they are accommodated in said first portion A'.

Said first portion A' further comprises a double wall transparent dome 8, to allow a complete visibility inside said portion A' and to act as an effective thermal and sound protection barrier of the internal environment of said portion A'.

Said dome 8 has at its ends a first guide 8*a* and a second guide 8*b*, on which respectively said first side panel 5 and said second side panel 6 slide.

Said portion A' is closed at the front by a front door 9 and at the rear by a rear door 10.

Said front door 9 comprises a frame 91, which is coupled with said dome 8, and a flap door 92, made of transparent material, which is fixed to said frame 91 by a pin 94 for opening and closing said flap door 92.

On said flap door 92 a rubberized slot 93 is obtained for the passage of cables and/or tubes.

Said rear door 10 has a plurality of openings 10*a*, 10*b*, . . . , 10*d* for the passage of oxygen cylinders and cables for the power supply of the incubator I. Said second portion A" is delimitated by a first side wall 53, coupled with said first guide 4*a*, on which said first panel 5 of said first portion A' slides, by a second side wall 63, coupled with said second guide 4*b*, on which said second panel 6 of said first portion A' slides, and by a top cover 65, fixed to said first 53 and second 63 side wall, in which a monitor 66 is integrated within a housing.

Said monitor 66 shows the vital parameters of the newborn accommodated within said incubator I and passes from a rest position, in which it is inserted in said top cover 65, to a parameter display position, by rotating around a hinge 66'.

Said monitor 66 can also be rotated sideways toward said first side panel 5 or towards said second side panel 6.

Said second portion A" is closed at the rear by a door 101, on which a first opening 101*a* and a second opening 101*b* are obtained for the passage of cables and medical instrumentation.

All the component elements of said second portion A' are made of plastic material to ensure compatibility with the tomographic apparatuses.

In operation, when a newborn at risk has to be transported by means of said incubator I, an operator opens said flap door 92 by rotating the pin 94, extracts said perforated base 7 from said first closed portion A' and puts there the newborn at risk.

Said perforated base 7 is then retracted inside said first closed portion A' and said flap door 92 is closed.

Said incubator I is then secured to a transport means, such as a spinal stretcher, resting said support structure S on said spinal stretcher and fixing said incubator I to said spinal stretcher by means of straps running through said first 1*a* and second 1*b* curb.

Medical staff views newborn's vital parameters by means of the monitor 66.

When intervening directly on the infant is necessary, medical staff can insert hands and arms inside of said first closed portion A' through said first porthole 51 and second porthole 52 of said first side panel 5 and/or through said first porthole 61 and second porthole 62 of said second side panel 6.

In case of X-ray or tomographic examination, the operator proceeds extracting said tray B, housing a radiographic plate and retract said tray B through said through slot 23 of said support base 2 and said slot of said through slot 43 of said base 4.

In case directly accessing to the infant is necessary, it is possible opening said first portion A' by sliding said first panel 5 along said first guide 4*a* of said first side wall 53 of said second portion A" and/or by sliding said second panel 6, along said second guide 4*b* on said second side wall 63 of said second portion A".

As it is evident from the above description, said incubator can be used compatibly with diagnostic imaging tomographic apparatuses, by the use of an extensible configuration.

Additionally, the limited dimensions both in length and in width ensure both transportability on devices adapted to emergency transport as well as the insertion within image diagnostic devices.

The present invention has been described for illustrative but not limitative purposes, according to its preferred embodiments, but it is to be understood that modifications and/or changes can be introduced by those skilled in the art without departing from the relevant scope as defined in the enclosed claims.

The invention claimed is:

1. A transport incubator comprising a support structure comprising a base, provided with at least one first guide, a housing structure, coupled with said support structure, comprising a first portion having at least one first side panel slidably coupled with said at least one first guide of said base, and a second portion, laterally delimited by at least one first side wall, wherein said at least one first side panel of said first portion slides on the at least one first side wall, wherein said base is provided with a second guide, arranged parallel with respect to said at least one first guide, said first portion comprises a second side panel, arranged facing to said at least one first side panel, slidably coupled to said second guide of said base, and said second portion is delimited by a second side wall, arranged facing with respect to said at least one first side wall, wherein said second side panel slides on said second side wall.

2. The incubator according to claim 1, wherein said support structure comprises a frame comprising a first curb and a second curb, and a plurality of U-shape support elements, for passage of fastening straps, are hooked on said first curb and said second curb.

3. The incubator according to claim 2, wherein said support structure comprises a U-shaped supporting base, which can be coupled with said frame and on which said base is fixed.

4. The incubator according to claim 3, wherein said base has a first through slot on a lateral surface of said base, said U-shaped support base has a second through slot overlapped on said first through slot of said base, and said base further comprises a tray removable from an inside of said first portion for insertion and subsequent extraction of radiographic sheets.

5. The incubator according to claim 1, wherein said base is provided with a first support frame, arranged parallel to and beside said at least one first guide, and a second support frame arranged beside and parallel to said second guide, and said first portion comprises a perforated base, sliding on said first and second support frame, wherein said perforated base is configured for a newborn to be placed on.

6. The incubator according to claim 1, wherein said at least one first side panel of said first portion comprises a first porthole provided with an opening handle and a second porthole provided with an opening handle, and said second side panel of said first portion comprises a first porthole provided with an opening handle and a second porthole provided with an opening handle.

7. The incubator according to claim 1, wherein said first portion is delimited at a top by a dome coupled with said at least one first side panel and second side panel.

8. The incubator according to claim 7, wherein said dome and said at least one first side panel and said second side panel are made of transparent plastic material.

9. The incubator according to claim 1, wherein said second portion is delimited at top by a top cover, coupled with said at least one first side wall and said second side wall, wherein a monitor is integrated in the first portion, wherein the monitor is configured to display vital parameters of a newborn accommodated within said first portion.

10. The incubator according to claim 9, wherein said monitor is coupled with said top cover by a hinge, and said monitor passes from a rest position, in which it is inserted into a housing of said top cover, to a parameter display position, by rotating around said hinge.

* * * * *